US005901583A

United States Patent [19]

Kemper et al.

[11] Patent Number: 5,901,583

[45] Date of Patent: May 11, 1999

[54] RASCHEL MACHINE WITH STITCH COMB AND KNOCK-OVER BAR

[75] Inventors: Rainer Kemper, Heusenstamm; Michaela Lorenz, Plauen, both of Germany

[73] Assignee: Karl Mayer Textilmaschinenfabrik GmbH, Obertshausen, Germany

[21] Appl. No.: 09/071,531

[22] Filed: May 1, 1998

[30] Foreign Application Priority Data

May 7, 1997 [DE] Germany ..... 197 19 125

[51] Int. Cl.[6] ..... D04B 27/24

[52] U.S. Cl. ..... 66/207; 66/203

[58] Field of Search ..... 66/203, 204, 206, 66/207, 208, 82 A, 825

[56] References Cited

U.S. PATENT DOCUMENTS 2,686,409 8/1954 Zwingenberger ..... 66/203
2,700,285 1/1955 Bellini ..... 66/208
3,063,273 11/1962 Kohl ..... 66/208

FOREIGN PATENT DOCUMENTS 1059140 6/1959 Germany .
1284025 11/1968 Germany .
2457950 6/1976 Germany .

*Primary Examiner*—John J. Calvert
*Assistant Examiner*—Larry D. Worrell, Jr.
*Attorney, Agent, or Firm*—Omri M. Behr, Esq.

[57] ABSTRACT

A raschel machine comprises a stitch comb bar 9 whose holder 11 are swingable by the stitch comb shaft 12 and a knock-over comb bar 6 whose holders 8 are secured against swinging by an out-rigger 8*a*. The stitch comb shaft 12 is contained in knock-over comb bar holders 8. These holders are carried by a supplemental shaft 18 which is displaceable relative to the machine frame 17 with the assistance of displaceable eccentrics 20. In this manner, it is possible to alter the displacement setting of the knock-over comb 4 and the stitch comb 5 at the same time.

12 Claims, 2 Drawing Sheets

RASCHEL MACHINE WITH STITCH COMB AND KNOCK-OVER BAR

1. Field of the Invention

The invention is directed to a raschel machine having a stitch comb bar whose holders are swingable about a stitch comb shaft and a knock-over comb bar whose holders are secured by an out-rigger against swinging, wherein the bars are displaceable for knock-over adjustment.

2. Description of Related Art

The greatest variety of textile surfaces can be produced on raschel machines, for example knitting, shoe materials, bodice merchandise, curtains, sportswear, and the like. The thus differentiable stitch structures require very differentiable knock-over conditions. That means that the stitches slide more or less easily from the slide or tongue needles. In order to procure the optimal changes with the raschel machine for a new article, readjustment of the knock-over setting is necessary.

In a raschel machine of the prior art (type RSE 4 produced by Mayer Textile Machine Corp.) the stitch comb shaft is rotatably borne in the carrying walls of the machine frame and fixed axially to a carrier wall through a fine adjustment arrangement. The stitch comb levers are rigidly affixed to the stitch comb shaft and are driven to-and-fro by a crank or cam plate drive. The knock-over comb bar holders are held on the stitch comb shaft and secured against rotation by an outrigger rigidly attached to the machine frame.

The knock-over adjustment, that is to say, the adjustment of the knock-over position of the knock-over comb results thereby, in that a screw coupling between the knock-over comb bar which carries the knock-over comb sinkers and the knock-over comb bar holders is loosened, the knock-over comb bar is raised upwardly, and finally the screw coupling is again pulled together. Thus, the knock-over comb bar is also loosened from its axial fixation and must therefore be provided with a new setting. This can lead to substantial problems with long machines having a high level of fineness since the bars of a warp knitting machine, as is known by experience, expand differently, undergo temperature changes and an exact arrangement of the knock-over sinker bar to the needle bar is no longer possible. In order to maintain the separation between the knock-over comb and the stitch comb, a new setting of the stitch comb bar is necessary in the adjustment of the knock-over as well. This results in a similar manner as that with the knock-over comb bar. Hence, similar problems arise.

In DE GM 1746642, a warp knitting machine, today automatically designated as a warp knitting automat is known, in which the stitch comb sinkers and the knock-over sinkers are replaced by common closing knock-over sinkers. Here, the bar is attached to reciprocating holders which are driven via a crank. The machine side pivot point of the swing lever is settable as to height by means of an eccentric cam.

For the sole adjustment of the close-off knock-over sinker in warp knitting automats, it is also known to carry the appropriate bar holders on adjustable eccentrics (DE AS 1284025, DE AS 1059140).

DE 2457950 describes a multipurpose machine which, at choice, can be utilized as a warp knitting automat or also as a raschel machine. For this purpose, the knock-bar may be removed from its working position by means of a 3-lever combination. Further, the close-off knock-over sinker bar is attached to a housing-affixed pivot point, swingable lever, whose length is changeable in order to bring the close-off knock-over sinkers into the knock-over height.

The task of the present invention is to provide a simpler mode of knock-over adjustment in a raschel machine of the prior art.

SUMMARY OF THE INVENTION

In accordance with the illustrative embodiments demonstrating features and advantages of the present invention, there is provided a raschel machine, having a machine frame, an out-rigger, and a knock-over holder. The knock-over holder has a knock-over bar and is secured by the out-rigger against swinging. The raschel machine also has a supplemental shaft supporting the knock-over holder and having eccentric means for adjustably displacing the knock-over holder relative to the machine frame. Also included is a stitch comb holder and a stitch comb shaft. The stitch comb shaft is borne by the knock-over holder. The stitch comb holder has a stitch comb bar and is mounted to swing about the stitch comb shaft. The stitch comb bar and the knock-over bar are displaceable for the purpose of knock-over adjustment.

By employing apparatus of the foregoing type an improved raschel machine is achieved wherein the stitch comb shaft is carried on the knock-over comb bar holders and wherein these knock-over comb bar holders are carried by a supplemental shaft which is displaceable relative to the machine housing by displaceable eccentric cams.

In this construction, the knock-over comb bar holders are no longer attached to the stitch comb shaft but rather on the supplemental shaft. Also, the stitch comb shaft is no longer carried on the carrying walls of the machine frame but rather on the knock-over comb bar holders. By displacement of the eccentric cams, both the stitch comb bar and the knock-over comb bar are displaced while maintaining their relative position. Furthermore, it is not necessary to loosen up an axial attachment.

It is advantageous that the out-riggers are carried by the support shaft, which, with the assistance of adjustable eccentric cams with equal eccentricity as those of the supplemental shaft, is displaceable relative to the machine frame. Accordingly, the support position of the out-rigger can be adjusted to the displacement of the knock-over comb bar holder in the area of the supplemental shaft, so that clamping is avoided.

It is desirable to provide that the eccentrics of the additional shaft and the support shaft are coupled to each other. This enables a central knock-over displacement setting in which it is only necessary to provide a lever or a hand wheel in order to swing away the support shaft and the supplemental shaft. The coupling can take place through any desired mechanisms.

The eccentrics are preferably formed by eccentric bushings which are supported in the carrier wall of the machine frame. These eccentric bushings take up the additional support shaft as well as the supplemental shaft in an eccentric bore and by a rotation of the named shaft are carried along in predetermined angular segments.

In a preferred embodiment, it is provided that the knock-over comb bar, as well as the axes of the stitch comb shaft and the supplemental shaft lie in substantially one plane and that the maximum knock-over displacement is less than double the eccentricity. Thus, since only one part of the theoretically possible displacement is utilized, it is achieved that in the knock-over position, a cross-motion of the knock-over comb bar is substantially avoided and the distance from the needle back remains the same.

It is further advantageous that the support shaft bearing on the out-rigger is formed by two separable half shells. By opening this bearing, the knock-over comb bar can be tipped forwardly so that the knock-over comb can be readily cleaned, for example, of cotton, which was left hanging during the processing of fiber threads.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
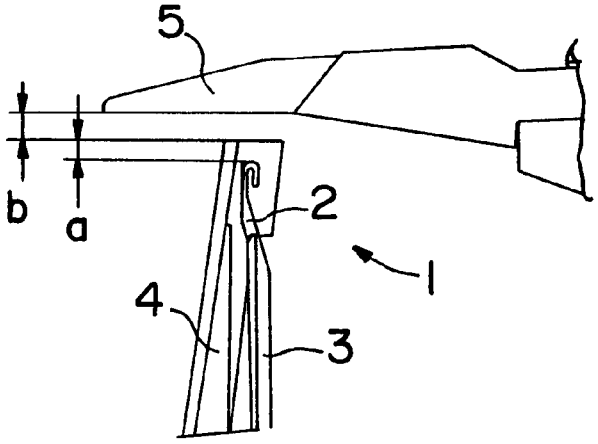
FIG. 1 is a representation of the working area of a conventional machine.
Figure 3:
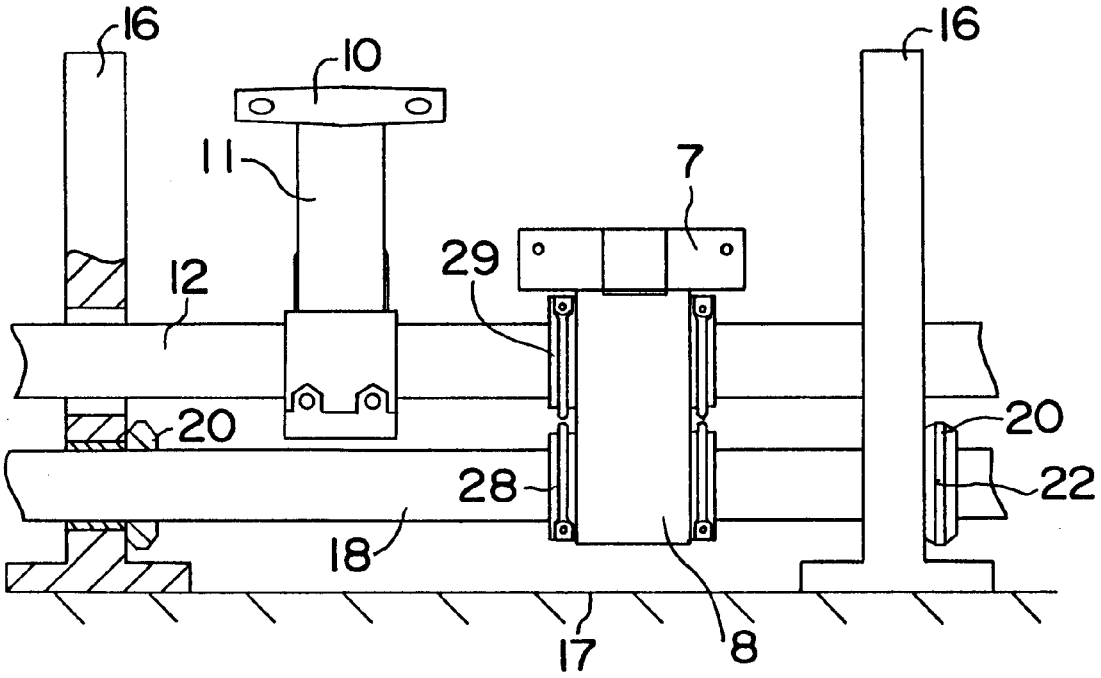
FIG. 3 is a partial plan view of FIG. 1 with bars removed.
Figure 2:
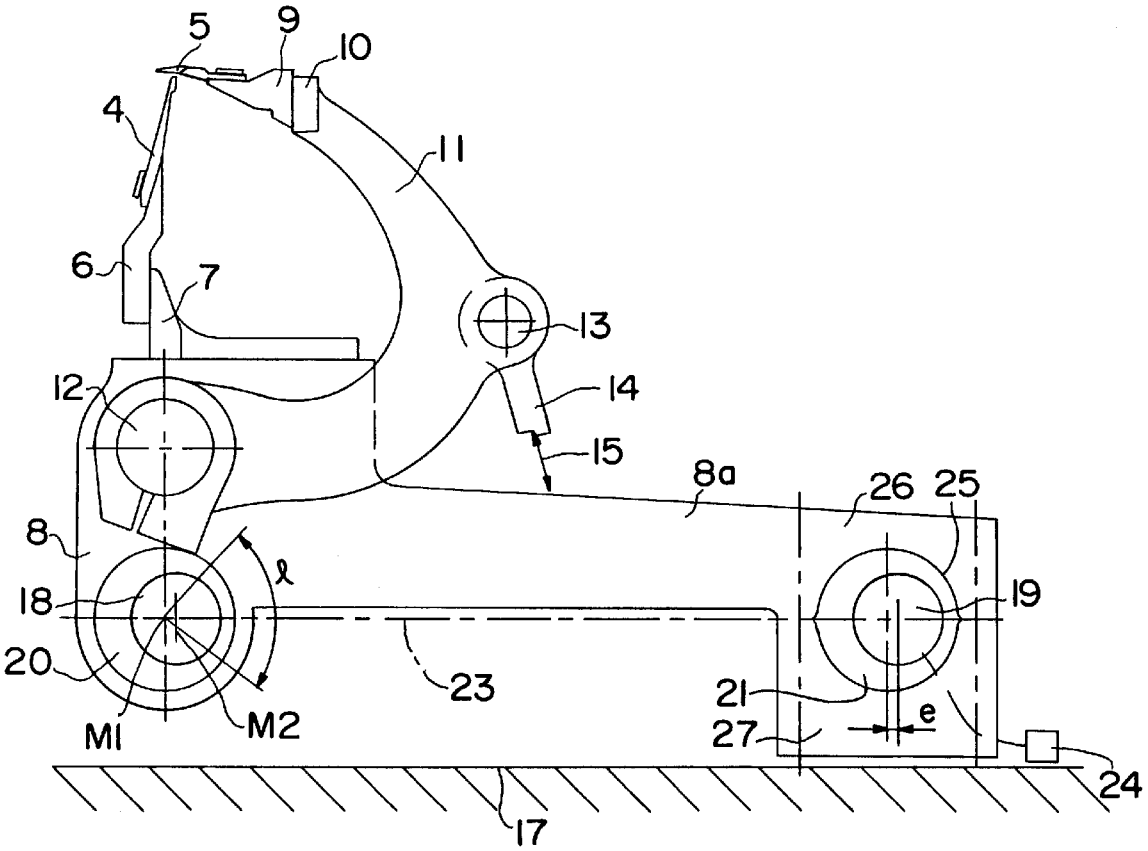
FIG. 2 is a partial side view of a machine in accordance with the present invention, in which the stitch comb bar and the knock-over comb bar carry parts.

Referring to FIGS. 1–3, the work area (1) of a machine comprises needles (2) shown here in the form of slider needles with appropriate sliders (3), a knock-over comb (4) and stitch comb (5). In a knock-over setting, the separation (a) between the upper edge of the knock-over comb (4) and the upper end of the needle (2), in its lowest setting may be altered while maintaining the distance (b) between the lower edge of the stitch comb (5) and the upper edge of the knock-over comb (4). The distance (a) can lie, for example, between 0 and 2 mm; preferably between 0.5 and 1.5 mm.

The knock-over comb (4) is formed by knock-over sinkers which are attached to a knock-over comb bar (6) which is installed on holding element (7) of the knock-over comb bar holder (8). The latter comprises an out-rigger (8*a*) which serves to secure the holder (8) against rotation. The stitch combs (5) are formed by stitch comb sinkers which are attached to a stitch comb bar (9), which on its side, is installed on holding elements (10) on stitch comb bar holder (11).

The stitch comb bar holders (11) are clamped onto a stitch comb shaft (12), which is rotatably mounted in the knock-over comb bar holder (8). A rod (14) grips into joint (13) which can reciprocate in the direction of arrow (15) under the influence of the main shaft (not shown) so that the stitch comb bar holders (11) are moved substantially perpendicular to the stroke of needles (2) in a to-and-fro manner.

In carrier walls (16) which are part of the machine frame, supplemental shaft (18) and a support shaft (19) are supported under the interposition of eccentric cams (20) and (21), formed as bushings. These bushings are attached to supplemental shaft (18) as well as support shaft (19) by means of screw (22). The distance between the mid-point (M1) of eccentric (20) and mid-point (M2) of the supplemental shaft (18) determines the eccentricity (e) effectively provided by this eccentric means. By rotation of the eccentric (20), it is theoretically possible to obtain a stroke displacement equal to double the eccentricity (e). Of this however, one merely uses a displacement angle $\alpha$ which is less than 180°. This allows one to obtain a knock-over displacement in the region of separation (a) without at the same time being required to take into account a too great extension of the knock-over comb (4), transverse thereto. With respect to eccentric (21) and support shaft (19), the same circumstances apply to provide an adjustable eccentric.

A link (23) between the supplemental shaft (18) and the support shaft (19) is shown which, for example, works through a lever guide rod linkage, or a chain, or gear wheel drive. Further, there is provided a common setting arrangement (24), for example with a lever or hand wheel, by whose activation the eccentrics (20) and (21) are rotated in common with the same displacement angle.

The out-rigger (8*a*) supports the support shaft (19) by means of a bearing (25) which is formed by two half shells (26) and (27). By removal of the lower half shell (27), the knock-over comb bar holder (8) can be swung around the supplemental shaft (18). By this means, the knock-over comb (4) can be opened up in order to better clean it.

Clamping rings (28) secure the axial bearing of the knock-over comb bar holder (8) and the clamp rings (29) axially secure the stitch comb shaft. During a knock-over displacement the previously adjusted axial position of the stitch comb and the knock-over comb (4) is maintained.

The eccentricity of the eccentrics (20) and (21) lies preferably in the range of 0.5 to 1.5 mm. Considering the limited swing angle $\alpha$, it is possible to obtain a knock-over displacement (a) of between about 1 to 1.5 mm, without substantially altering the distance to the needle bed.

Because the knock-over comb (4) and the axes of the swing lever shaft (12) and the supplemental shaft (18) lie substantially in one plane, the displacement of the eccentrics (20) and (21) leads to an equal displacement of the knock-over combs (4) and the stitch combs (5).

It is appreciated that various modifications may be implemented with respect to the above described, preferred embodiment. Thus, in place of utilizing slider needles, one may use tongue needles or other types of needles. In place of eccentric bushings, one can utilize eccentric pivots.

Obviously, many modifications and variations of the present invention are possible in light of the above teachings. It is therefore to be understood that within the scope of the appended claims, the invention may be practiced otherwise than as specifically described.

We claim:

1. A raschel machine, comprising a machine frame;

an out-rigger;

a knock-over holder having a knock-over bar and being secured by said out-rigger against swinging, a supplemental shaft supporting said knock-over holder and having eccentric means for adjustably displacing the knock-over holder relative to the machine frame;

a stitch comb shaft being borne by the knock-over holder; and a stitch comb holder having a stitch comb bar and being mounted to swing about said stitch comb shaft, the stitch comb bar and said knock-over bar being displaceable for the purpose of knock-over adjustment.

2. A raschel machine in accordance with claim 1, comprising:

a support shaft having an adjustable eccentric with eccentricity matching that of said eccentric means for carrying the out-rigger and displacing it relative to the machine frame.

3. A raschel machine in accordance with claim 2, wherein the eccentric means and the adjustable eccentric of the supplemental shaft and the support shaft are linked together.

4. A raschel machine in accordance with claim 3, wherein the eccentric means comprises:

an eccentric bushing carried by the machine frame.

5. A raschel machine in accordance with claim 2, wherein the eccentric means comprises:

an eccentric bushing carried by the machine frame.

6. A raschel machine in accordance with claim 1, wherein the stitch comb bar and the supplemental shaft have axes of rotation substantially coplanar with the knock-over bar, with knock-over adjustment being less than twice the eccentricity of the eccentric means.

7. A raschel machine in accordance with claim 2, wherein the stitch comb bar and the supplemental shaft have axes of rotation substantially coplanar with the the knock-over bar, with knock-over adjustment being less than twice the eccentricity of the eccentric means.

8. A raschel machine in accordance with claim 3, wherein the stitch comb bar and the supplemental shaft have axes of rotation substantially coplanar with the knock-over bar, with knock-over adjustment being less than twice the eccentricity of the eccentric means.

9. A raschel machine in accordance with claim 1, wherein the out-rigger comprises:

a pair of separable shells for encompassing the support shaft and acting as a bearing.

10. A raschel machine in accordance with claim 2, wherein the out-rigger comprises:

a pair of separable shells for encompassing the support shaft and acting as a bearing.

11. A raschel machine in accordance with claim 3, wherein the out-rigger comprises:

a pair of separable shells for encompassing the support shaft and acting as a bearing.

12. A raschel machine In accordance with claim 6, wherein the out-rigger comprises:

a pair of separable shells for encompassing the support shaft and acting as a bearing.

* * * * *